United States Patent [19]

Wolters

[11] Patent Number: 4,773,689

[45] Date of Patent: Sep. 27, 1988

[54] APPARATUS FOR CLAMPING TO THE END OF A PIPE

[75] Inventor: Jakob Wolters, Wegberg/Beeck, Fed. Rep. of Germany

[73] Assignee: Wirth Maschinen-Und Bohrgerate-Fabrik GmbH, Erkelenz, Fed. Rep. of Germany

[21] Appl. No.: 51,642

[22] Filed: May 20, 1987

[30] Foreign Application Priority Data

May 22, 1986 [DE] Fed. Rep. of Germany ..... 3617227

[51] Int. Cl.[4] ..... B66C 1/56

[52] U.S. Cl. ..... 294/88; 294/96; 294/905

[58] Field of Search ..... 294/66.1, 86.1, 86.15, 294/86.17, 86.24, 86.25, 88, 90, 93–98.1, 905; 166/98, 120, 125, 138, 187, 212, 217; 405/158; 414/626

[56] References Cited

U.S. PATENT DOCUMENTS

| | | | |
|---|---|---|---|
| 2,203,799 | 6/1940 | Shaffer | 294/93 X |
| 3,310,335 | 3/1967 | Shuey | 294/905 X |
| 3,751,932 | 8/1973 | Matthews | 294/94 X |
| 3,842,612 | 10/1974 | Arnold | 294/96 X |
| 3,985,384 | 10/1976 | Hahn | 294/88 |
| 4,050,731 | 9/1977 | Coone et al. | 294/86.24 |
| 4,235,469 | 11/1980 | Denny et al. | 294/96 |
| 4,320,915 | 3/1982 | Abbott et al. | 294/96 |
| 4,526,413 | 7/1985 | Williams | 294/88 |

FOREIGN PATENT DOCUMENTS

| | | | |
|---|---|---|---|
| 3420860 | 12/1985 | Fed. Rep. of Germany | 294/93 |

*Primary Examiner*—Johnny D. Cherry
*Attorney, Agent, or Firm*—Holman & Stern

[57] ABSTRACT

Releasable spider-type clamping apparatus for clamping to the end of a pipe comprises a system including a normal industrial line connection between a supply and control unit and the spider and a controllable operating device on the spider itself for operating and adjusting the clamp members, at least for the purpose of releasing them in the event the normal industrial line connection fails, the operating device comprising a pressure medium system with at least one pressure medium storage device and a wireless remote control and/or manual system.

6 Claims, 2 Drawing Sheets

APPARATUS FOR CLAMPING TO THE END OF A PIPE

BACKGROUND OF THE INVENTION

1. Field of Invention

The invention relates to apparatus, such as a spider, clamping body, manipulating head, or the like, which can be clamped to the end of a pipe.

2. Description of Prior Art

Units usually called spiders or elevators are attached to the end of a pipe in order to carry out certain operations or sequences of movements with the pipe. See U.S. Pat. Nos. 4,235,469 and 4,320,915. Spiders of this type are particularly used in offshore engineering for the purpose, inter alia, of taking up a pipe which is in a horizontal position on a ship, a platform, etc. and then lowering it into a vertical position, if necessary to a considerable depth under the water. In order to retrieve the spider so as to use it again it must be released from the pipe. The devices or adjusting means which are used for this purpose to move the clamp plates or the like are connected to a supply and control device disposed on the ship or on a platform by flexible tubes or appropriate conduits. If these are damaged or break, it is usually impossible to release the spider from the pipe, or only at a disproportionately high expense.

SUMMARY OF THE INVENTION

The object of the invention is to counter existing inadequacies and disadvantages and provide an apparatus which is capable of releasing a spider or the like from a pipe, without this involving a great deal of time or work, should the above-mentioned line connection fail for some reason and become inoperative. Another object of the invention is to provide an advantageous construction of the individual parts of the apparatus.

The invention provides apparatus which can be releasably clamped to the end of a pipe by means of clamp members or shoes and comprises adjusting means which are to be supplied with pressure medium, particularly in a cylinder-piston-unit construction, for moving the clamp members, supply and control means being connectable by pressure medium lines to the adjusting means of the spider, and controllable operating means for the adjusting means for the clamp member, at least for the purpose of releasing them, which comprises a pressure medium system with at least one pressure medium store.

This enables the apparatus to be released from the pipe, independently of the normal supply condition, and made ready for use again.

The operating means can be rendered operative or controlled by means of a member which is accessible from the outside of the apparatus. This member may be a lever, a knob at the end of a traction element, etc., which is connected to a corresponding part of the operating means and can act on this part.

This enables the apparatus to be released from its clamped state, even manually, for example in a shallow depth of water or by using a diver for just a brief time.

It is especially advantageous if a remote control system is provided for the operating means. A wireless remote control system, e.g. an acoustic system, represents a particular possibility, although a control line, separate from other routes, could also be considered for a remote control system.

The operating means advantageously comprises a control valve which has a stop position and at least one other position in which the adjusting means can be operated for releasing purposes. A control valve of this type can be adjusted by a member at the apparatus and/or by remote control. It is advisable for both possibilities to be available.

In a further development of the invention the operating means comprises a second control valve which has a stop position and at least one other position in which the adjusting means for the clamp members can be operated for clamping purposes. This provides the additional possibility of not just releasing the apparatus from the pipe independently of the normal operating supply condition, but also independently securing it to a pipe.

The invention is of particular advantage for so-called internal spiders which are clamped inside pipes. However, it is also suitable for other spiders, for example those which are clamped to the pipe from outside. The invention therefore includes different designs of these types of spiders.

Further details, characteristic features and advantages of the invention will become evident from the following description, the accompanying drawings, and the claims.

DETAILED DESCRIPTION OF PREFERRED EMBODIMENT

Figure 1:
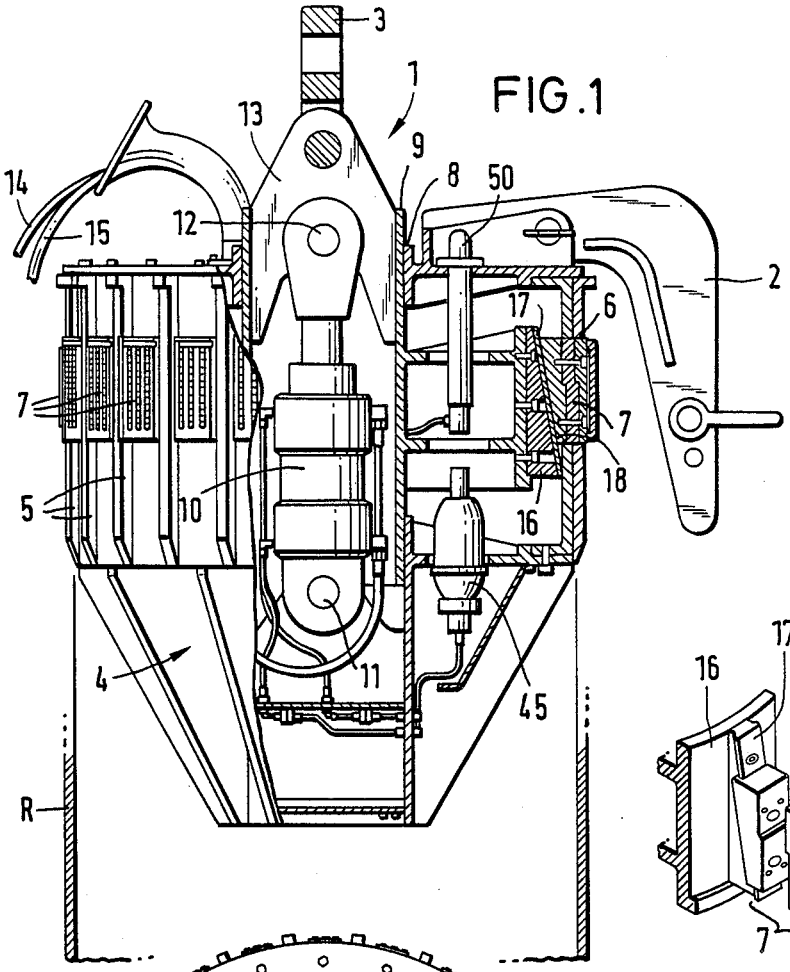
FIG. 1 shows a spider in accordance with the invention partly in elevation and partly in longitudinal cross section.
Figure 2:
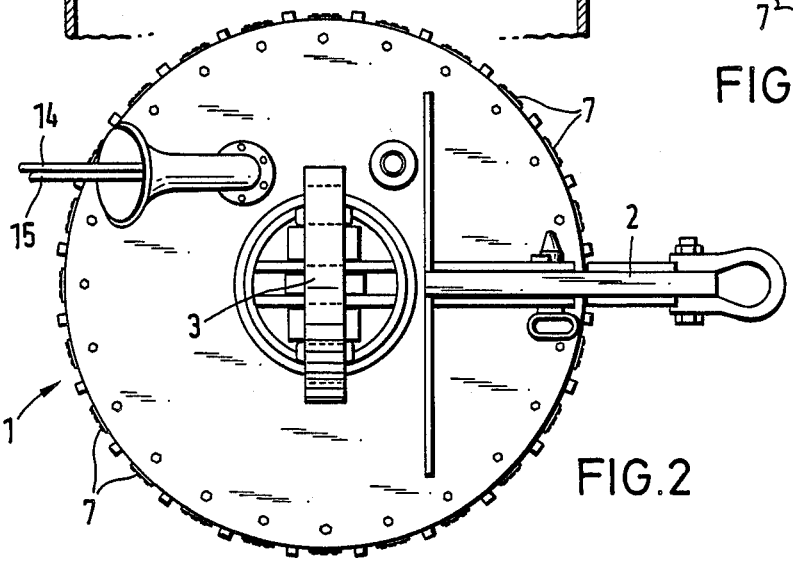
FIG. 2 is a top plan view of the spider of FIG. 1.

The device shown in FIGS. 1 and 2 is an internal spider or elevator, which is designated as a whole by the number 1, which can be inserted into the end of a pipe R and which can be secured to this pipe. The spider 1 has a supporting arm 2 on which a lifting appliance (not shown) can engage in order to raise the pipe R out of the horizontal position shown and transfer it into a vertical position. In the vertical position the spider 1 can be gripped at a lifting eye 3 by another lifting appliance, e.g. a crane, so that the spider 1 with the pipe R, which it is holding, can be lowered to the required depth.

The spider 1 comprises a housing or supporting structure 4 with guide bars 5 which are distributed over its circumference and between which openings 6 for the passage of gripping members or clamp shoes 7 are provided.

An internal member 9 is axially displaceable to a limited degree in internal guideways 8 of the housing 4. A hydraulic piston-cylinder-unit 10 is connected at the cylinder end by a trunnion 11 to the housing 4 and at the piston rod end by a trunnion 12 to a yoke 13 secured to the internal member 9. Supply and removal lines 14 and 15 for the pressure medium for operating the unit 10 are provided.

Figure 3:
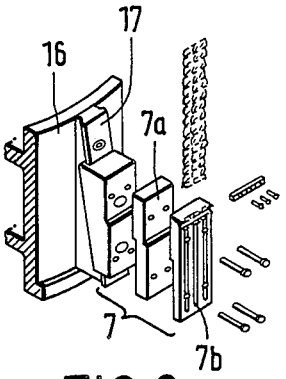
FIG. 3 is an exploded view of a clamp shoe in accordance with the invention.

The internal member 9 comprises an operating element 16 with an inclined surface 17 for each clamp shoe 7. Each clamp shoe 7 is provided at its radially internal side with an inclined surface 18 having the same inclination as surface 17, e.g. 9°. As can be seen from FIG. 3, the clamp shoe can consist of a number of parts, in particular replaceable spacers *7a* for altering the gripping diameter, and can comprise external claws *7b*.

If the piston rod of the unit 10 is extended, the internal member 9 is moved relative to the housing 4 and, owing to the inclined surfaces 17 and 18, the clamp shoes 7 are moved outwards and pressed firmly against the inside of the pipe R. The spider 1 is thus firmly secured to the pipe R, so that the pipe can be manipulated as desired by means of the spider. The connection between the spider 1 and the pipe R can be released by operating the unit 10 in the opposite manner, in which case the internal member 9 is pushed axially into the housing 4 (downwards in FIG. 1) and the clamp shoes 7 can be released from the pipe. If necessary, a spring action or similar means can be provided for further assistance.

Figure 4:
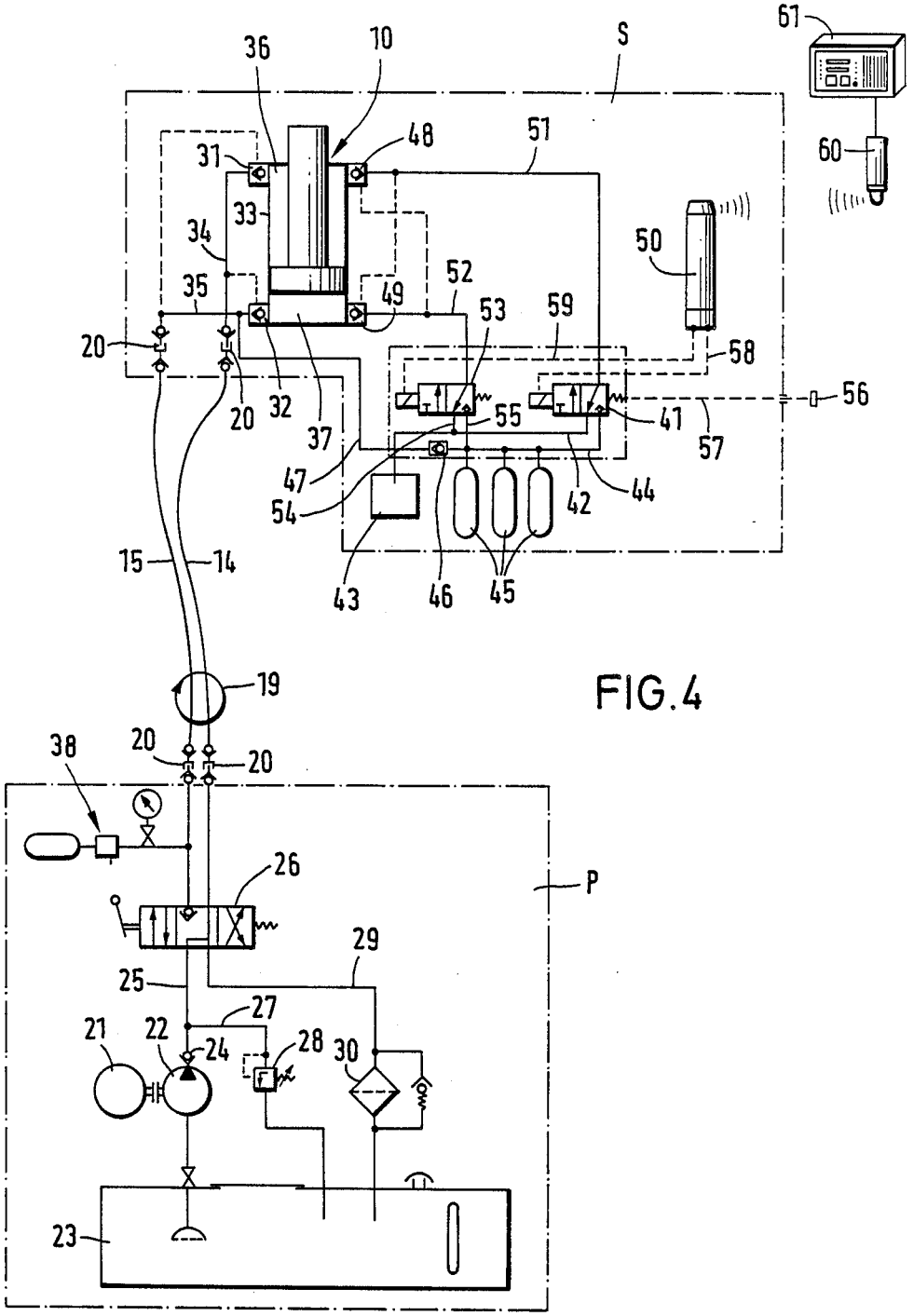
FIG. 4 is a circuit diagram of a system including the spider in accordance with the invention.

The piston-cylinder-unit 10 can be controlled from an operating position which may be located on a ship, an offshore platform, or a corresponding unit. Those parts of a pressure medium system which are illustrated in FIG. 4 in the area P bounded by dot-dash lines can in particular be arranged there. The second area S bounded by dot-dash lines in FIG. 4 is a diagrammatic illustration of those parts which belong to the spider 1 or are arranged on it. The pressure medium lines 14,15 lead from the unit P to the spider S, while a winch drum 19 for the lines 14 and 15 allows the lines to be lengthened or shortened according to the depth to which the spider and the pipe are lowered. Detachable connections 20 link the lines 14,15 to the relevant units.

The pressure medium system is shown as a hydraulic system. However, a different pressure medium may be used. A pump 22 driven by an electromotor 21 sucks hydraulic oil out of a tank 23 and delivers it via a non-return valve 24 to a pressure line 25 connected to a 4/3-way valve 26. A branch line 27 leads from the pressure line 25 via a pressure-relief valve 28 to the tank 23. A return line 29, which leads into the tank 23, is also connected to the directional valve 26 and can contain a filter 30. A reservoir system 38 is also provided.

In the area S belonging to the spider 1 lines 34 and 35 are provided as continuations of lines 14 and 15 and in each case lead via openable non-return valves 31,32 to the annular space 36 and the free space 37 of the cylinder of the unit 10. According to the position of the valve 26, pressure medium can either be supplied to the annular space 36, in order to retract the piston of the unit 10 and thus release the clamp shoes 7 (FIG. 1), in which case the medium will flow out of the free space 37 of the cylinder 33, or pressure medium can be supplied to the free space 37, in order to push the piston in the cylinder 33 out and clamp the spider 1 to the pipe R, in which case the medium can flow out of the annular space 36 and back to the tank 23 via the lines 34,14, the valve 26, and the line 29. The unit 10 is dimensioned such that the clamp shoes will always be released if the admission of the pressure medium is appropriate for this purpose.

The area S, i.e. the arrangement belonging to the spider 1, comprises a first control valve 41 constituted by a 3/2-way valve which is connected via a line 42 to a container 43 and via a line 44 to a pressure medium store 45. In the embodiment according to FIG. 4 the store consists of three storage units arranged in parallel, although it may also be formed by one unit. The pressure medium store 45 can be charged via a line 47 which contains a non-return valve 46 and which branches off from the line 35.

The annular space 36 of the cylinder 33 and its free space 37 are connected to lines 51 and 52 via openable non-return valves 48,49, from which the line 51 is connected to the valve 41. If the design of the valve 41 is modified, e.g. if it is formed as a four-way valve, the line 52 can also lead to this valve. In the illustrated extended embodiment a second control valve 53 is provided which is also a 3/2-way valve to which the line 52 is connected. One of the other two connections of this valve 53 is connected via a line 54 to the discharge line and the other is connected via a line 55 to the storage line 44.

On the one hand, the control valve 41 can be mechanically actuated by means of a lever, a manually operated knob 56, or the like, which is arranged on the spider 1 so that it is accessible from outside and can therefore be actuated by an operator or diver. It is connected to the valve 41 via a mechanical transmission member 57, e.g. a bar, a cord, or the like.

On the other hand, the valve 41 can also be remotely actuated, particularly by electromagnetic means. A control line 58, which connects the electromagnetic actuator of the valve 41 to a receiver 50, which also comprises a battery or other power supply is used for this purpose. The receiver 50 is arranged to receive remote control signals delivered by a transmitter 60 connected to an appropriate supply and control unit 61 which is of a type known per se and is disposed at an operating position for the device. The remote control system with the transmitter 60 and the receiver 50 may in particular be formed as an acoustic remote control system. In this case, and when other systems are used, an appropriate choice of frequencies enables different signals for different commands to be delivered, and commands in the form of coded signals can also be sent.

The receiver 50 is also connected by a line 59 to the electromagnetic actuator of the valve 53.

The valves 41 and 53 are shown in their rest positions, i.e. in the state which corresponds to the normal operation of the device, in which case the cylinder-piston-unit 10 is operated from the operating position by actuating the valve 26 and using the flexible lines or tubes 14,15.

Should it happen that, for example when the pipe R and the spider 1 are lowered to a considerable depth into the sea, the lines 14,15 are damaged or break due to external influences so that the unit 10 can no longer be supplied by these lines, it is still possible to release the clamp shoes 7 and thus separate the spider 1 from the pipe R by using the device illustrated above, so that the spider 1 can be raised and retrieved without this entailing any special expenditure.

All that is required is the sending of an appropriate signal from the device 61 at the operating position which is transmitted from the transmitter 60 to the receiver 50 via the wireless transmission path and actuates the valve 41 so that it moves into the other of the two positions. This enables pressure medium to travel from the store 45 to the annular space 36 of the cylinder 33 via the line 51, as a result of which the piston is pushed in and the clamp shoes 7 are consequently released. The medium which has in the process been expelled from the free space 37 of the cylinder 33 flows to the container 43 via the line 52, the valve 53, and the lines 54 and 42. If a second valve 53 is not provided, the medium expelled from the occupied space 37 during the release operation can be discharged directly into the open.

In the illustrated embodiment the second control valve 53 also enables the spider 1 to be secured to a pipe R. For this purpose a signal can be released from the transmitter 61 which only actuates the valve 53, while the valve 41 remains in its rest position.

Instead of using remote control, the valve 41 can be actuated manually in order to release the spider 1 by means of the members 56 and 57. There is also the possibility of manually actuating the valve 53 by means of a member which is accessible from the outside of the spider 1.

I claim:

1. Apparatus for releasable clamping to the end of a pipe, comprising:

a support structure;

clamping members movably mounted on said support structure;

adjusting means operable by a pressure medium, for moving said clamping means between a clamping position and a releasing position;

pressure medium supply means;

control means for controlling pressure medium from said supply means;

connecting means for connecting said adjusting means to said pressure medium supply means and control means via pressure medium lines; and controllable opening means mounted on the support structure for operating said adjusting means for moving said clamping members to at least said releasing position comprising a pressure medium system including at least one pressure medium storage means, conduit means for connecting said pressure medium system to said adjusting means, control valve means operatively connected to said conduit means for controlling pressure medium between said pressure medium system and said adjusting means, said control valve means having a stop position for disconnecting said adjusting means from said pressure medium system and at least one operating position for operating said adjusting means by said pressure medium system for moving said clamping members to either one of said clamping and releasing positions, and a wireless remote control system for operating said control valve means.

2. The apparatus as claimed in claim 1 wherein:

said wireless remote control system comprises an acoustic remote control system.

3. The apparatus as claimed in claim 1 wherein said adjusting means comprises:

an internal member displaceably mounted in said support structure;

at least one cylinder-piston-unit acting between said internal member and said support structure; and operating elements mounted on said internal member and engaging said clamping members for operating said clamping members.

4. A pipe manipulation system comprising the apparatus as claimed in claim 1 wherein:

said pressure medium supply means and control means are remote from the apparatus.

5. Apparatus for releasable clamping to the end of a pipe, comprising:

a support structure;

clamping members movably mounted on said support structure;

adjusting means operable by a pressure medium, for moving said clamping members between a clamping position and a releasing position;

pressure medium supply means;

control means for controlling pressure medium from said supply means;

connecting means for connecting said adjusting means to said pressure medium supply means and control means via pressure medium lines; and controllable operating means mounted on the support structure for operating said adjusting means for moving said clamping members to at least said releasing position comprising a pressure medium system including at least one pressure medium storage means, conduit means for connecting said pressure medium system to said adjusting means, control valve means operatively connected to said conduit means for controlling pressure medium between said pressure medium system and said adjusting means, said control valve means having a stop position for disconnecting said adjusting means from said pressure medium system and at least one operating position for operating said adjusting means by said pressure medium system for moving said clamping members to either one of said clamping and releasing positions, and an actuating member mounted on said support structure and operatively connected to said control valve means for actuating said control valve means from outside the apparatus.

6. The apparatus as claimed in claim 5 and further comprising:

a remote control system, said control valve means being operable both by said actuating member and by the remote control system.

* * * * *